US006828949B2

(12) United States Patent
Harless

(10) Patent No.: US 6,828,949 B2
(45) Date of Patent: Dec. 7, 2004

(54) SOLID SURFACE IMPLEMENTATION FOR DEPLOYABLE REFLECTORS

(75) Inventor: Richard I. Harless, West Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 55 days.

(21) Appl. No.: 10/134,418

(22) Filed: Apr. 29, 2002

(65) Prior Publication Data

US 2003/0201949 A1 Oct. 30, 2003

(51) Int. Cl.[7] ..... H01Q 15/20
(52) U.S. Cl. ..... 343/915; 343/912
(58) Field of Search ..... 343/912, 913, 343/914, 915, 916, 840; H01Q 15/20

(56) References Cited

U.S. PATENT DOCUMENTS

| | | | | |
|---|---|---|---|---|
| 4,001,836 A | | 1/1977 | Archer et al. | |
| 4,686,150 A | * | 8/1987 | Talley et al. | 428/593 |
| 4,784,700 A | * | 11/1988 | Stern et al. | 136/248 |
| 4,860,023 A | | 8/1989 | Halm | |
| 5,104,211 A | * | 4/1992 | Schumacher et al. | 359/853 |
| 5,198,832 A | | 3/1993 | Higgins et al. | |
| 5,451,975 A | * | 9/1995 | Miller et al. | 343/915 |
| 5,644,322 A | * | 7/1997 | Hayes et al. | 343/915 |
| 5,990,851 A | | 11/1999 | Henderson et al. | |
| 6,028,570 A | | 2/2000 | Gilger et al. | |
| 6,081,244 A | | 6/2000 | Peck | |
| 6,104,358 A | | 8/2000 | Parker et al. | |
| 6,229,501 B1 | | 5/2001 | Roth et al. | |
| 6,278,416 B1 | | 8/2001 | Harless | |
| 6,313,811 B1 | | 11/2001 | Harless | |
| 6,624,796 B1 | * | 9/2003 | Talley et al. | 343/915 |

* cited by examiner

*Primary Examiner*—Hoanganh Le
(74) *Attorney, Agent, or Firm*—Sacco & Associates, PA

(57) ABSTRACT

A deployable reflector includes a support structure having a plurality of support members. The support members are movable from a compact stowed configuration to a deployed configuration. Selected portions of the support members define a prescribed surface when in the deployed configuration. A continuous reflector material is provided restrained against the support members defining the prescribed surface. The reflector material comprises a flexible solid reflector surface.

18 Claims, 7 Drawing Sheets

SOLID SURFACE IMPLEMENTATION FOR DEPLOYABLE REFLECTORS

BACKGROUND OF THE INVENTION

1. Technical Field

The present invention relates generally to foldable dish reflectors and, more particularly, to implementation of reflective surfaces for foldable dish reflectors that are suitable for higher radio frequencies and solar energy concentration 2. Description of the Related Art Foldable dish reflectors are commonly used for radio antennas and solar collectors in terrestrial and space based applications. One conventional approach to implementation of systems of this type makes use of a foldable framework that can support a reflective surface. A wide variety of structures have been developed for such foldable framework systems. Reflective surfaces are conventionally mounted to these structural supports.

Conventional deployable reflectors have typically made use of one two basic types designs for reflector surfaces. One approach uses a segmented solid reflector surface made from rigid or semi-rigid panels arranged on a supporting structure that can be folded within a spacecraft prior to launch. A second design is comprised of a mesh material arranged on a support structure.

The segmented solid surface approach is shown in U.S. Pat. No. 5,104,211. The structure approximates compound curvature surfaces by using a three-dimensional arrangement of compactly stowable flat reflective panel segments. The semi-rigid panel segments are deployed on an umbrella-like framework of radially extending ribs, struts and cords. The ribs, struts and cords deploy away from a central hub to form a system of radial trusses.

Similarly, U.S. Pat. No. 6,229,501 also illustrates a segmented solid surface approach. The system uses a number of individual hexagonal reflectors that can be arranged around a rigid central element. The reflectors are made from foldable, form stable CFK Carbon-Faser-verstärkter Kunststoff (German synonym for Carbon-Fiber-Reinforced Plastic "CFRP") that has been coated with a metalized foil. The respective reflectors are folded or deployed in the manner of an umbrella.

Yet another solid surface design is disclosed in U.S. Pat. No. 4,860,023 wherein a parabolic reflector antenna for telecommunication satellites implements a reflector using a honeycomb core sandwiched between two Kevlar sheets. A metal grid is applied to the surface of at least one of the Kevlar sheets for establishing a surface sensitive to the frequency of the RF signals.

U.S. Pat. No. 5,198,832 discloses a mesh type reflective surface that has been used for deployable reflector systems. The system uses flexible polyester knitted mesh fabric to form the reflector surface. The fabric is plated with a reflective metal coating and is designed to be elastic, particularly in a radial direction.

U.S. Pat. No. 6,313,811 also discloses a deployable antenna that utilizes a mesh type reflective surface. The system uses includes radial and hoop support members for deploying a surface, such as a metallic mesh antenna material that is reflective of electromagnetic energy. Similarly, U.S. Pat. No. 6,278,416 discloses a system of cords and ties for supporting a metallic mesh reflector surface.

One problem with solid panel type reflector surfaces is the inherent complexity of folding rigid segmented panels.

Another problem such rigid panel systems are the weight and volume associated with their deployment. Further, in their deployed configuration, segmented rigid or semi-rigid panels generally have a small gap or overlap between adjacent panels. Discontinuous areas such as these can be detrimental to Radio Frequency (RF) performance because they cause products of intermodulation (PIM). Additionally these discontinuities can disperse the reflected RF energy in undesirable directions that create or increase RF sidelobes.

The mesh approach solves many of these problems as it facilitates inherently simpler deployment and lighter weight. However, mesh materials are not suitable for all reflector applications. In conventional systems, the reflector material has been formed of a metallic or metal plated mesh material. When tensioned by the support structure, the conventional mesh material will define interstices or spaces between the fibers or filaments forming the mesh. These interstices limit the usefulness of currently available mesh material as reflector surfaces, particularly for frequencies above about 15 GHz.

It is possible that tighter mesh designs will eventually facilitate operation at frequencies ranging from 20 to 30 GHz. Beyond these frequencies, however, mesh solutions to the reflector problem exhibit increased loss and therefore become impractical. Further, mesh designs are simply not suitable for use in other applications such as solar concentrators.

In addition to the mesh reflectivity loss due to interstices, there are also electrical conductivity effects. To explain, one must understand the basics of knit mesh. Mesh is knit on machines that feeds-in individual gold plated wires, performs the knitting operation, and outputs knitted mesh. Thus in one direction, the direction of knit, the mesh inherently should have excellent electrical conductivity, as the wires are continuous in this knit direction. However for the mesh to maintain electrical conductivity in the direction perpendicular to this knit direction, the mesh must be tensioned sufficiently to ensure adequate contact pressure between individual wire elements. This requires that the mesh be tensioned in this lateral direction. The lateral tension, due to the material behavior of the mesh, generates a tension in the knit direction as well. Thus in order to maintain electrical conductivity to achieve the necessary RF reflectivity, the mesh material must be tensioned in both the knit and lateral directions.

Another reason the mesh must be tensioned is geometric. Mesh in its untensioned state, does not maintain a smooth, semi-flat shape. It must be tensioned in order to impose and hold a reasonably flat surface. Depending upon the characteristics of the particular mesh material and knit, the amount of tension required to maintain an adequately smooth, semi-flat shape can vary. The tension must also be adequate to smooth-out any wrinkles or other imperfections that may be present as the mesh is pulled into its deployed shape from its stowed condition. If the deployed, tensioned mesh is insufficiently smooth, the geometric effects may lead to additional RF loss due to surface roughness.

This presence of tension in the mesh required, as explained above, to meet surface roughness and electrical conductivity requirements has another detrimental effect. There are two components to this effect. The first relates to the flat facet approximation to the parabolic surface generally employed in reflector antenna. Assuming for a moment that the tensions in the mesh are adequate to ensure geometric flatness and electrical reflectivity, one can further assume that the mesh forms a flat facet between each set of tie points that are held by the cord/tie or other backup structure. The desired parabolic surface reflector is a doubly curved surface. Assuming the mesh at the tie points is held correctly to coincide with the parabolic surface then, between these points, the mesh will necessarily deviate from the desired, doubly curved surface even if the mesh between the tie points lies in a perfectly flat plane. This is the flat facet approximation. The degree of deviation from the desired parabolic surface can be improved to some extent by making the distance between tie points smaller.

The flat facet approximation is the first part of the detrimental tension effect. The second has to do with the true behavior of a pre-tensioned membrane. The flat facet approximation assumes the mesh between tie points is ideally flat. However, the physical behavior of tensioned mesh shows that the mesh, between tie points, is not flat. Instead, the mesh bulges up above the flat facet, towards the focal point of the paraboloid. This can be accurately predicted through use of the equations governing a doubly curved, pre-tensioned membrane. It has also been validated by experimental measurement and on numerous deployable reflector surfaces. The bulge is dependent upon the focal length of the paraboloid and the tension in the membrane.

Thus, the geometric surface accuracy achievable with tensioned mesh is limited by the tension itself. Even if the density of the mesh is increased to provide adequate RF reflectivity at higher frequencies, the geometric limit due to these detrimental tension effects is another limiting factor to overcome.

The ideal surface is one that has a high degree of flexibility and folds readily like mesh to stow, yet needs no pre-tension to maintain its deployed geometry. Accordingly, there is a need for a suitable reflector surface system that can provide performance at higher radio frequencies while avoiding the deployment problems associated with rigid or semi-rigid solid surface reflectors.

SUMMARY OF THE INVENTION

The invention concerns a deployable solid surface reflector. The deployable reflector includes a support structure that is formed from a group of support members. The support members are movable from a compact stowed configuration to a deployed configuration such that selected portions of the support members define a prescribed surface when in the deployed configuration. For example, the prescribed surface can be a parabolic surface. A continuous reflector material formed from a flexible solid surface is provided and restrained against the support members defining the prescribed surface.

According to one aspect of the invention, the support structure can be comprised of a plurality of radially extending support ribs and a plurality of circumferentially extending support cords. The support cords can define the prescribed surface between adjacent ones of the support ribs.

In order to be movable from a stowed configuration to a deployed configuration, the continuous reflector material can have a bending stiffness of between about 0.1 to 10 inch-pounds. Further, for space-based applications, the continuous reflector material preferably has a relatively low coefficient of thermal expansion of less than about $1.0\times10^{-6}/°$ F. or one part per million (ppm) per degree Fahrenheit.

According to one aspect of the invention, the deployable reflector material can be comprised of a laminate comprising a woven quartz cloth material or a unidirectional quartz lamina, each pre-impregnated with a resin such as an epoxy resin. Alternatively, the material can be a laminate comprising graphite and epoxy. If the material used to form the solid surface is non-conductive or non-reflective, then a suitable reflective layer such as aluminum or some other metal layer can be applied to provide the reflective properties.

DETAILED DESCRIPTION OF THE PREPFERRED EMBODIMENTS

Figure 1:
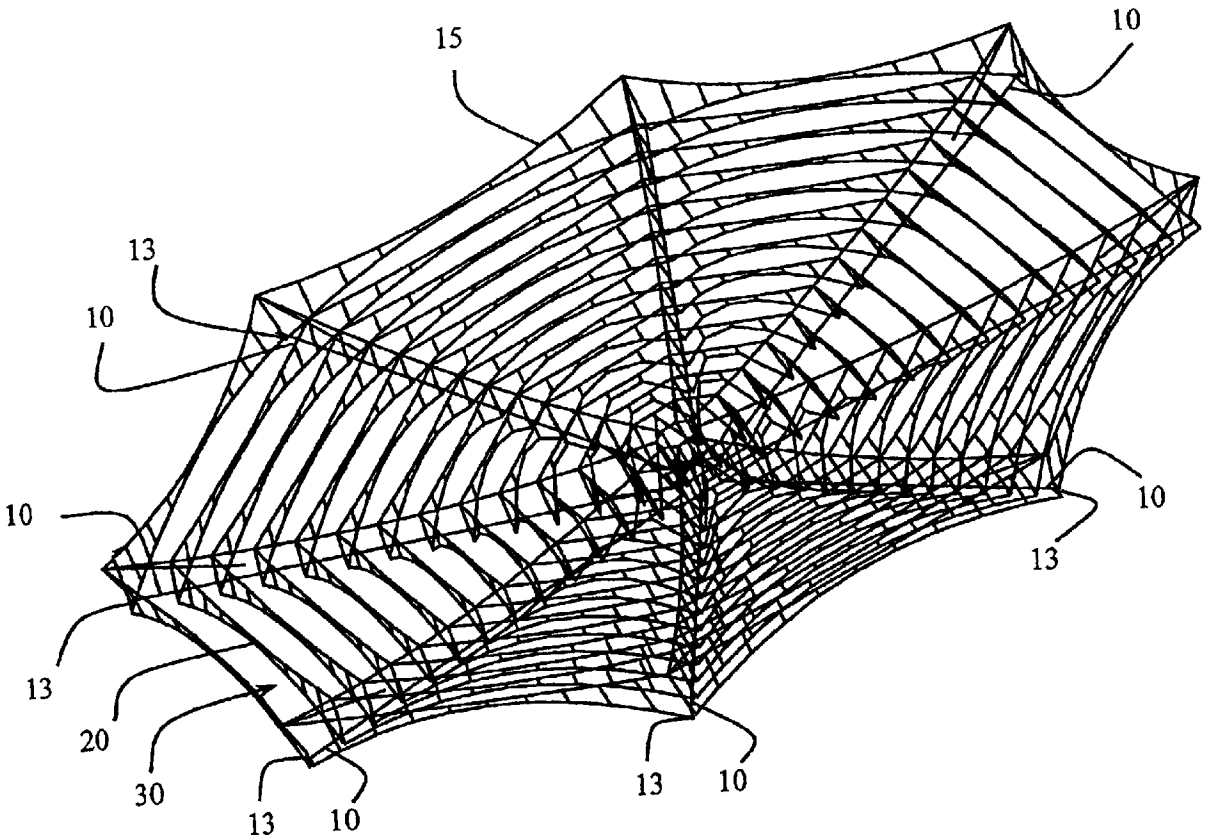
FIG. 1 is a diagrammatic perspective view of a conventional umbrella-configured reflector support surface.
Figure 2:
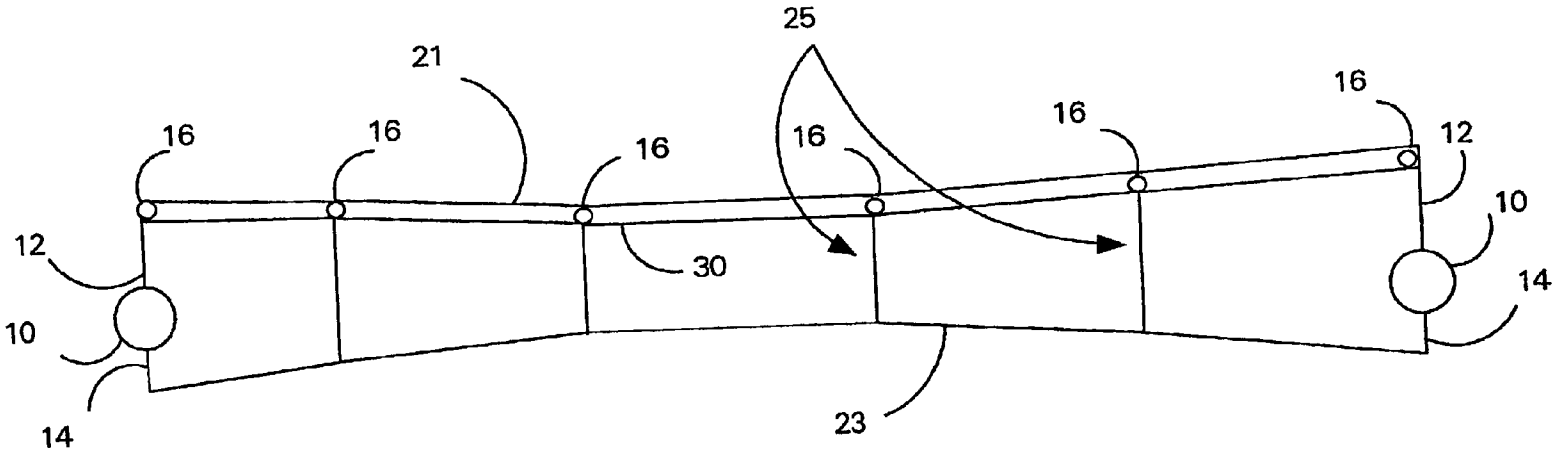
FIG. 2 is a side view of a set of circumferentially extending support cords employed in the umbrella-configured reflector of FIG. 1.

The basic architecture of a conventional reflector support structure is diagrammatically shown in the perspective view of FIG. 1. The structure shown is sometimes referred to as a cord and tie structure, and is described in greater detail in U.S. Pat. No. 6,278,416 B1, incorporated herein by reference. As illustrated in FIGS. 1 and 2, a deployable reflector support structure can comprise an arrangement of radially extending ribs 10, and associated sets of circumferentially extending support cords 20 connected between the ribs. The structure is preferably movable from a compact stowed configuration to a deployed configuration. The stowed configuration can vary from one design to another but commonly can include folding the ribs 10 in the manner of an umbrella in a direction that is roughly parallel to a central axis defined by the parabola.

As shown in greater detail in the side view of FIG. 2, each set of support cords 20 is typically organized into pairs, comprised of a front cord 21 and a rear cord 23, that are joined to one another via multiple tie cords 25 there between. Opposite ends of the front and rear cords 21, 23 are respectively attached to a front tie 12, and rigid rear standoffs 14, supported by and extending generally orthogonal from the ribs 10, so that each set of support cords 20 is placed in tension by a pair of radial ribs 10 in a generally catenary configuration.

To achieve the required surface accuracy, the tie cords 25 are usually adjustable in length. Other embodiments may adjust rear cord 23 at one or both ends in addition to the tie cord 25 adjustment. Still other high accuracy designs manufacture the tie cords 25 to their desired, precise and non-adjustable length, using only adjustments in the rear cord 23 to attain surface accuracy. All these techniques are proven capable of providing highly accurate surfaces.

The reflector material 30 is restrained against the front cords 21 at their attachment points 16 with the tie cords 25. As a consequence, when the support structure is deployed, the front cords 21 define a prescribed surface with which the attached tensioned reflector material 30 conforms. Radially outermost or 'intercostal' cord sets in FIG. 1 to which the outer peripheral edge 15 of the reflector material is attached, are typically connected to stand-offs at distal ends 13 of the ribs 10.

When unfolded from its stowed configuration to its deployed configuration, the foregoing structure supports a reflector material 30 that serves as the intended reflective surface. According to a preferred embodiment, the reflector material 30 can be formed as a highly flexible solid material having a low coefficient of thermal expansion. The reflective surface can be electrically conductive and RF reflective for antenna applications and/or can be optically reflective.

In general, cord and tie support structures as illustrated in FIGS. 1 and 2 are preferred for use with the inventive arrangements as they allow control by design of the distance between hard support points. This is particularly important in the present application as the flexible, relatively thin, solid reflector material limits the distance over which the reflector material must support itself. The cord and tie support structures are advantageous in this regard as they can be designed to provide support as close as every 2 or 3 inches as may be necessary for very thin, flexible reflector materials.

Figure 4:
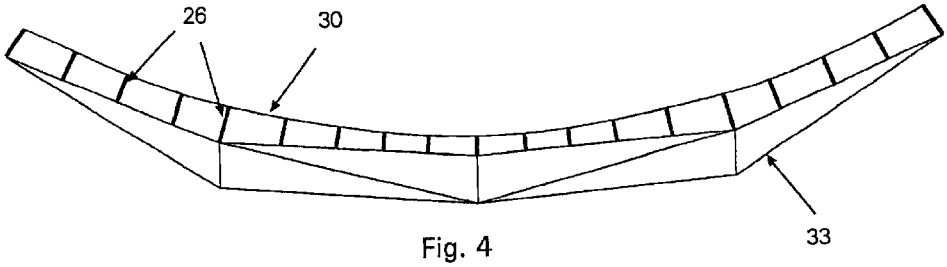
FIG. 4 is a cross-sectional diagrammatic view of a first alternative support structure that can be used with the invention.

It should be understood that the invention is not limited to the support structure illustrated in FIGS. 1 and 2. Instead, any other deployable or even non-deployable structure can be used with the invention, provided that it is capable of establishing a sufficient number of support points for the relatively thin reflector material. For example, as illustrated in FIG. 4, a non-deployable backup structure 33 that provides mounting points can also be used for this purpose. In the configuration the cord/tie structure can be replaced with a set of extensible members 26. This has the desirable characteristic of allowing adjustment of the surface of reflector material 30 by lengthening or shortening the individual extensible members 26. According to a preferred embodiment, the extensible members 26 can be oriented perpendicular to the surface of reflector material 30 to maximize control of the surface geometry in the most critical direction, normal to the surface of reflector material 30. This orientation also minimizes the interaction between adjacent extensible members 26. Further, the extensible members 26 can advantageously be configured so that they can extend and contract in length. At each end, the extensible members 26 can preferably attach via a ball type joint to reflector material 30 and backup structure 33. This joint is important to reduce build-up of any local bending moment, especially at the surface interface, that might occur during adjustment of extensible member 26.

Figure 5:
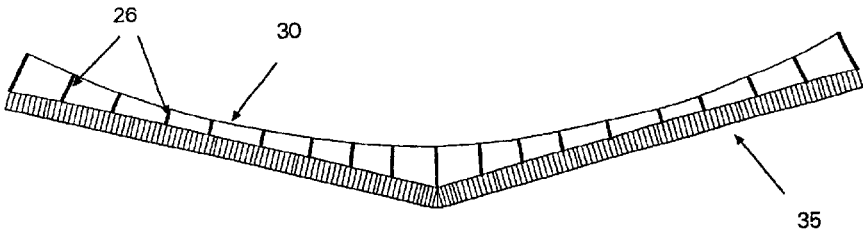
FIG. 5 is a cross-sectional diagrammatic view of a second alternative support structure that can be used with the invention.
Figure 6:
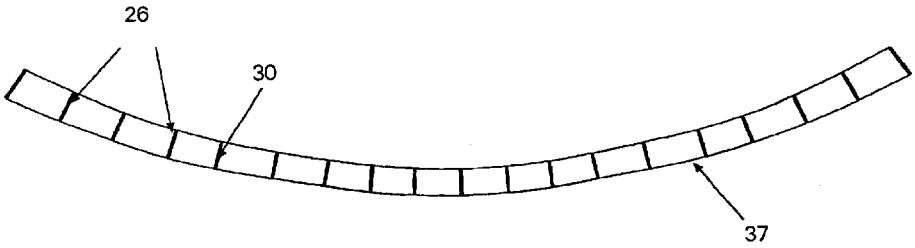
FIG. 6 is a cross-sectional diagrammatic view of a third alternative support structure that can be used with the invention.

The backup structure can be of many design types. For example a truss arrangement can be used as shown in FIG. 4. Alternatively, as illustrated in FIG. 5, a honeycomb sandwich composite 35 can also be used for this purpose. In yet a further alternative embodiment illustrated in FIG. 6, the support structure can be comprised of another thin flexible solid surface 37. The flexible solid surface 37 can advantageously be formed from a material similar to that proposed herein for the reflective surface.

According to a preferred embodiment, the reflector material 30 is formed as a highly flexible, solid surface. Utilizing this approach overcomes many of the problems associated with conventional mesh reflectors while maintaining the advantage they offer in terms of deployment and packaging. The reflector material 30 can be formed of any solid material having a low coefficient of thermal expansion that is both highly flexible and which has suitable reflective properties for the optical or electromagnetic frequencies of interest. As used herein, the term "solid" refers to reflector materials that do not have open spaces or gaps in such as those found in metallic mesh systems. The reflective properties of the solid surface reflector can be either inherent to the material or can be selectively applied over a base as a reflective layer. In any case, the solid surface is particularly important in this application as it ensures that the reflective surface will exclude the interstices, discontinuities and other problems commonly associated with conventional mesh type reflector material.

In order to accommodate the transition from a stowed configuration to a deployed configuration, the reflector material 30 must be highly flexible. A preferred range for bending stiffness (defined as $Et^3$, where E is the elastic modulus and "t" is the thickness of the reflector material) is on the order of 0.1 to 10 inch-pounds. In general, materials with smaller values of bending stiffness are preferred as they provide more flexibility to fold the reflector into a smaller package when stowed.

The reflector material is also preferably selected so as to have a low coefficient of thermal expansion (CTE). This value is particularly important for a space based deployable reflector system, as the temperature environment in outer space is very severe. Accordingly, it is preferable to make use of reflector materials that will have relatively small amounts of thermal distortion. For example, CTE values on the order of $1.0\times10^{-6}/°$ F. are preferred for the reflector material 30. It should be noted that this requirement greatly limits the range of available materials as it eliminates the possible use of most metals. Quartz is an ideal candidate for the reflector material laminate as it has a very low CTE and is a very well understood material. Also, since it is non-conductive, it reduces PIM risk.

Figure 3:
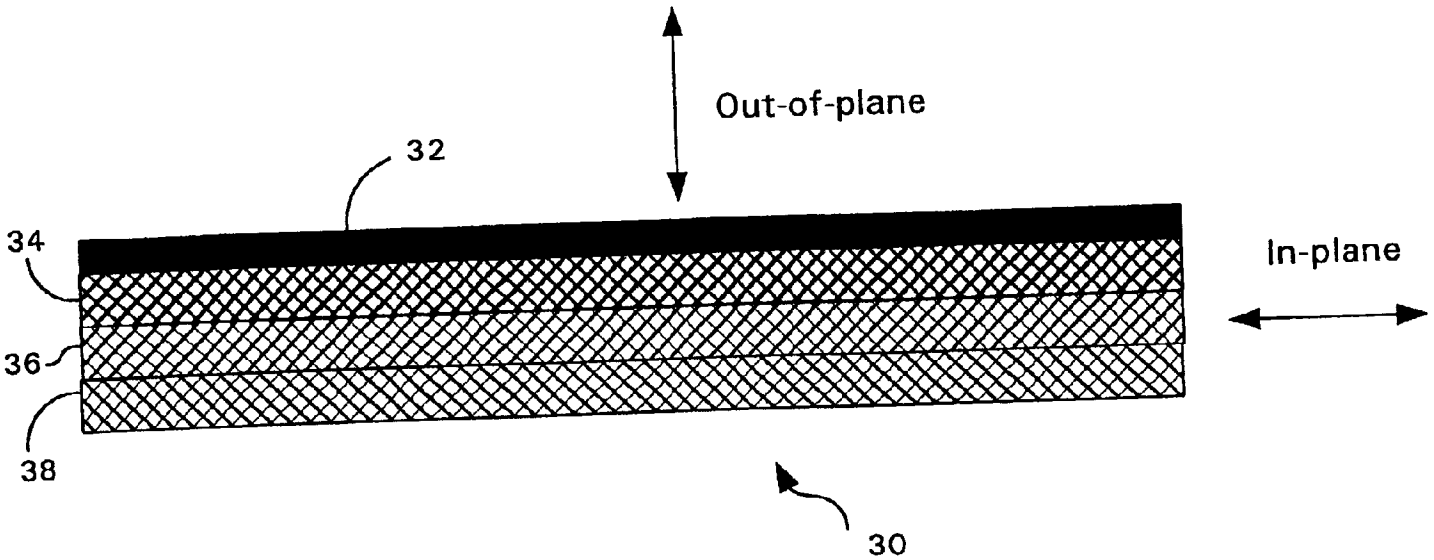
FIG. 3 is a cross-sectional view of a solid surface laminate reflector material.

According to a preferred embodiment illustrated in FIG. 3, the reflector material 30 can be formed as a laminate. One or more laminate layers 34, 36, 38 can be formed using a woven quartz cloth material. Such material is commercially available in thin form ~1 to 2 mils (0.001 to 0.002 inches) thick, pre-impregnated with an epoxy resin.

In FIG. 3, there are three layers, or plys, 34, 36, 38 of quartz material. However, it will be appreciated that any number of layers can be laminated together provided that the desired material flexibility and CTE is maintained. The thickness of the final laminated reflector material 30 would be determined by a variety of factors, including the reflector focal length. Focal length is important, as it is the dominant factor determining the curvature inherent in the deployed reflector surface. In general, the more curved the surface the more the surface must flex in order to stow.

Quartz/epoxy laminates are particularly advantageous in the present application as they are less likely to produce products of intermodulation ("PIM"). In general, PIM refers to the spurious generation of unwanted RF signals when a surface is illuminated by an RF source. Conventional solid surface reflector designs that are formed from individual reflector panel segments can be particularly prone to generation of PIM. These spurious signals are commonly attributed to discontinuities occurring between segments forming the reflector surface. The laminated surfaces as described herein provide a substantial advantage in this regard as they can be formed from continuous sheets of reflector material, exclusive of any gaps or discontinuities that can be present in segmented solid surface reflector designs.

Another form of quartz-based material that can be used to form the flexible solid reflector is a unidirectional lamina. Unidirectional lamina is the common form for most graphite and quartz composite materials. It consists of small diameter fibers all running in the same direction, embedded in an epoxy matrix. By laying-up individual lamina (also known as plys) the properties of the composite can be tailored to provide strength, stiffness, CTE, etc required to meet a specific application. Generally, these materials are used because they are very light yet as strong as common steels. Layers of this material can be laminated, actually cured, together as shown in FIG. 3 with each layer having its own orientation with respect to the other layers. Some possible orientations include a two layer 0°/90° layup and a three layer 0°/−60°/+60° layup. The possibilities of number of layers and their orientations is virtually limitless, it being understood that thinner laminates are preferred as they generally result in better performance, i.e. greater flexibility. Each type of layup will have its own unique stiffness and thermal expansion behavior.

If the laminate is formed from a quartz material, then it is necessary to include a reflective layer 32 suitable for the particular electromagnetic or optical energy of interest. Examples of suitable reflective layers for electro-magnetic energy would include aluminum or other conductive materials such as gold, silver or nickel. An example process to apply aluminum to the composite is vapor deposited aluminum, commonly referred to as VDA. This VDA process could also suffice to reflect optical energy as required for solar collectors. Nominally the thickness of the reflective layer 32 is much smaller than that of the plys 34, 36, 38 in FIG. 3, on the order of several thousands of Angstroms. At approximately 4 millionths of an inch per thousand Angstroms, the coating thickness is many times smaller than the ply thickness. While this is one particular method for coating application, those skilled in the art will recognize that the invention is not so limited and other types of reflective layers can also be used.

According to an alternative embodiment, the reflector can also be formed from graphite/epoxy laminates. These materials can be arranged in a variety of different orientations and with varying numbers of layers (plys) so as to meet the stiffness and CTE requirements as described herein. Proper design of a graphite laminate can yield a thin, highly flexible material with relatively small CTE. However, one drawback to the use of graphite is that it is a conductor and thus may present a PIM problem.

The solid reflector material 30 according to a preferred embodiment is ideally formed as single continuous sheet extending over the entire reflector surface so as to avoid discontinuities. The reflector material 30 is preferably fabricated and cured on a mold so that it inherently has a pre-determined curvature that matches the prescribed curved surface defined by the desired paraboloid. For larger surfaces where a single continuous sheet becomes impractical, the whole could be made from segments provided continuous electrical contact between each segment is ensured. For optical uses, the continuity of electrical contact is probably not required thus alleviating this requirement and making the possibility to manufacture from individual segments more attractive.

Unlike conventional mesh reflectors, the reflector materials 30 for use with the present invention are not tensioned when deployed on the support structure. This avoids the detrimental pre-tension effects addressed in the prior discussion. Additionally, it is desired that the reflector material 30 remain unloaded or un-tensioned when deployed in the orbital environment. Since the on-orbit thermal environment is rather severe with temperatures ranging from −300° F. to +200° F., the importance of low CTE becomes apparent. The expansion/contraction of the surface relative to that of the support structure must be controlled to avoid build-up of in-plane tension or compression of the surface. The in-plane direction is noted in FIG. 3 as the direction lying in the plane of the surface laminate. Out-of-plane is also noted. While the material should hold the desired shape as defined by the mold curvature, any appreciable build-up of compressive stress can lead to a local buckling of the surface between the tie points. This could compromise the surface accuracy and lead to undesirable RF or optical losses.

To address these on-orbit accuracy issues, the stability of the backup structure becomes important. Since the reflector material 30 is required to be very flexible, it will have little out-of-plane stiffness. Thus, it is incumbent upon the support structure to provide, via the tie points, the stability to hold the reflector material 30 in its required position.

Figure 8:
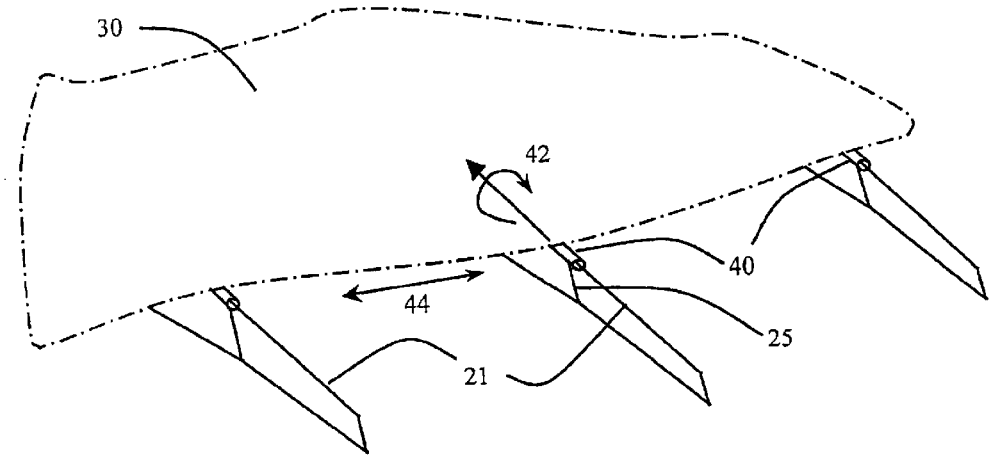
FIG. 8 is an enlarged view of a portion of FIG. 7 that is useful for illustrating an attachment structure.

The cord/tie structure described in FIG. 2 may take one of at least two forms. As illustrated in FIG. 1, the support cords 20 span the distance between the radially oriented ribs 10. This network provides a system of essentially parallel mounts between successive support cords 20 for the reflector material 30. FIG. 8 shows a series of three successive sets of support cords 20 with reflector material 30 mounted to the topside of the front cord element 21. This marks one difference between this mounting and that of mesh reflector implementations. Mesh reflectors attach below the front cord element 21 to take advantage of the fact that the mesh tension tends to bulge the mesh in an upward direction. The presence of the cord 21 helps reduce this bulge, providing increased accuracy for the reflector. In the solid implementation of this invention there is no mesh tension nor is there any resultant bulge to reduce.

Figure 7:
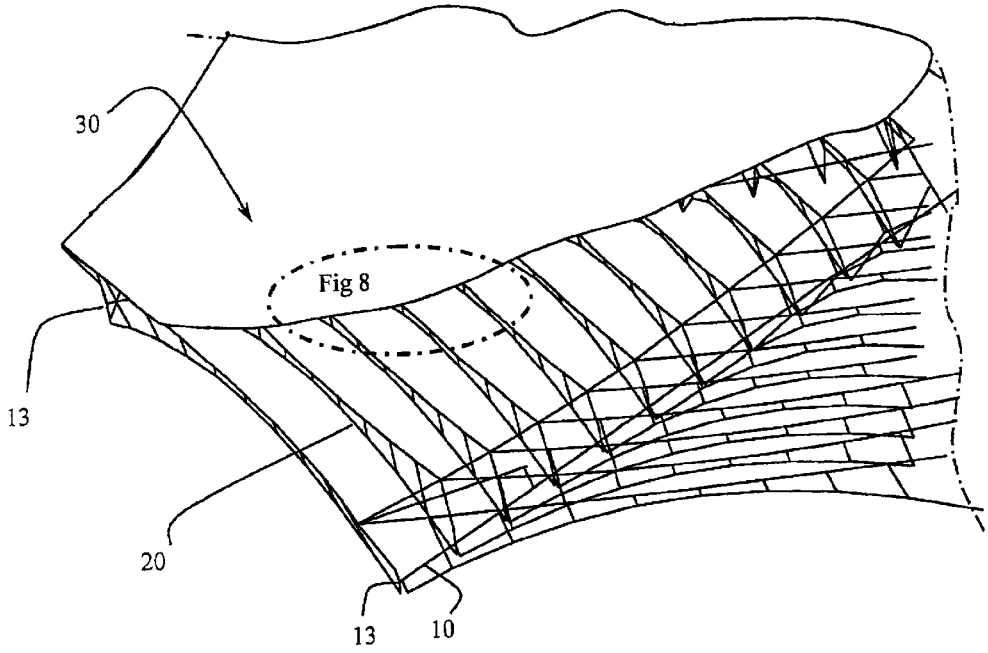
FIG. 7 is a perspective view of a deployable antenna that is useful for illustrating the attachment of a solid surface reflector.

FIGS. 7 and 8 provide a notional concept for attachment of the reflector material 30 to the front cord 21. At or near intersections of ties 25 and the front cord 21, a tubular feature 40 can be bonded to the backside of the reflector material 30. The tube diameter is preferably selected to allow the front cord 21 sufficient clearance to pass through an interior of the tubular feature 40. To ease assembly, the tube 40 can be slit allowing the cord to be inserted into the tube without having to physically thread the front cord 21 through the tube 40. Once assembled in place on the backup structure, with the ties and cords in their proper geometry, the front cord 21 is bonded to the inside of tube 40 thereby fixing the reflector material 30 to the front cord 21. This method of attachment provides minimal rotational stability about the axis of the front cord 21 as depicted by arrow 42 in FIG. 8. This may not be desirable as relative in-plane radial direction (double arrow 44 FIG. 8) movement of the front cord 21 with respect to its neighbor may generate loads that cause this type of rotation. A potential source of this kind of movement is on-orbit thermal elastic distortion.

Figure 9:
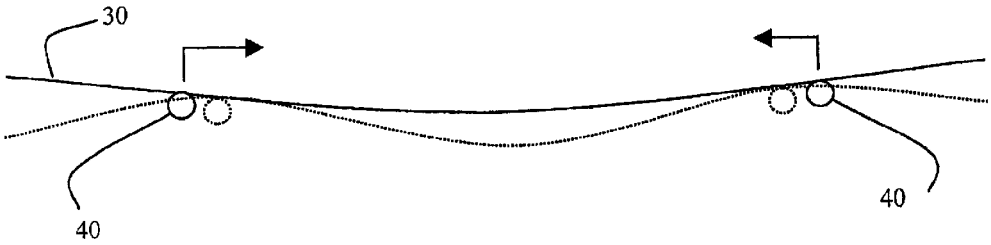
FIG. 9 is a cross-sectional view of a solid surface reflector and a portion of the underlying support structure that is useful for showing reflector distortion.

FIG. 9 describes the nature of the foregoing effect. FIG. 9 is a cross-sectional view looking along the axis of the front cords 21 as shown in FIG. 8. The solid lines in FIG. 9 indicate the desired position of both the reflector material 30 and the front cord tubes 40. The dashed lines show a possible distorted position of the same elements once the in-plane radial distortion indicated by the arrows is imposed. As the distorted (dashed) line illustrates, the reflector material 30 is moved significantly from its original, ideal position. This is an undesirable effect as the distortion creates unwanted surface roughness.

Figure 10:
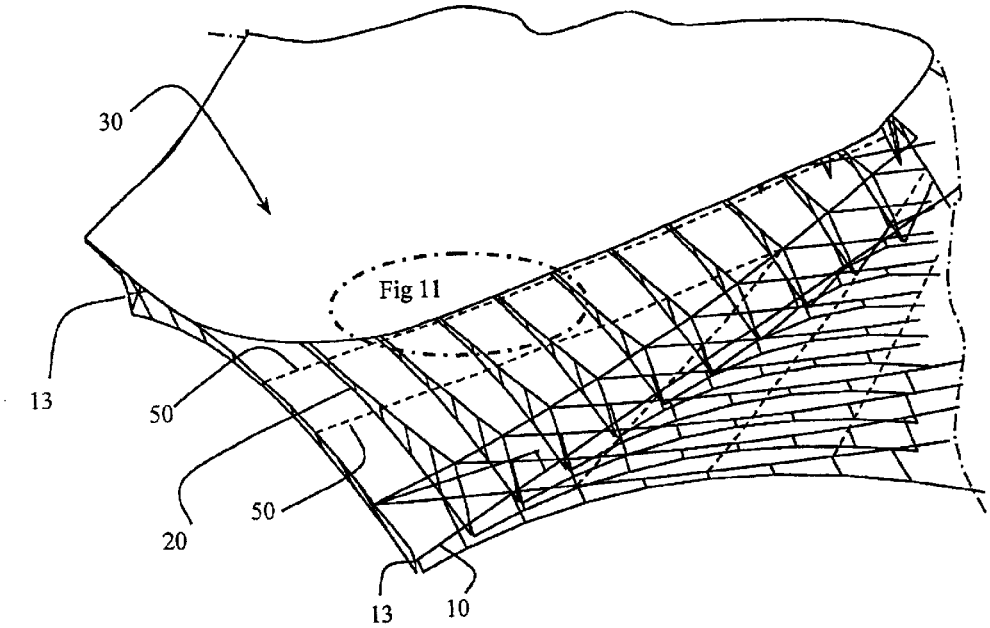
FIG. 10 is a perspective view showing a cord and tie support structure with additional radially oriented cords.
Figure 11:
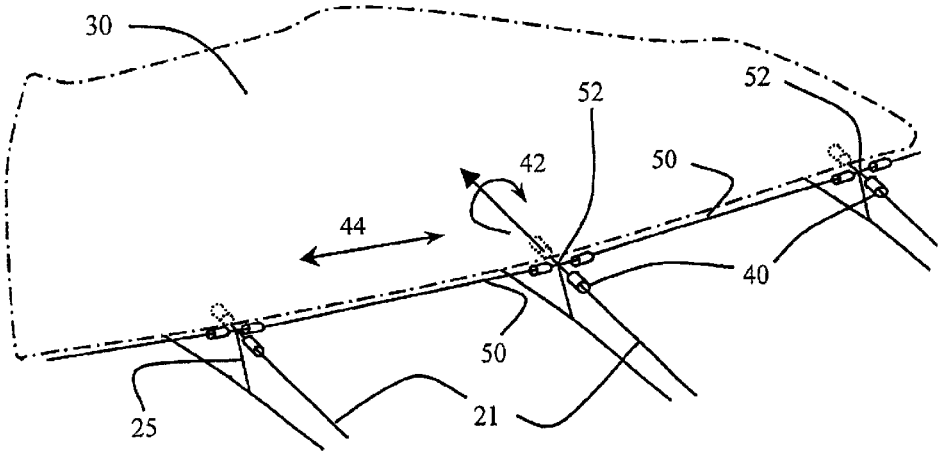
FIG. 11 is an enlarged view of a portion of FIG. 10 showing an alternative attachment structure.
Figure 12:
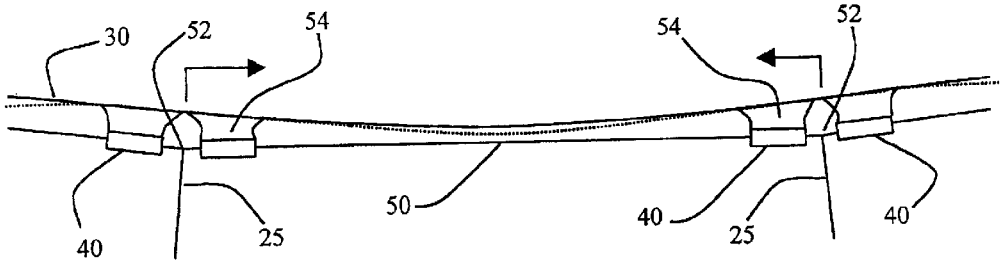
FIG. 12 is a cross-sectional view of the solid surface reflector and a portion of the underlying support structure that is useful for showing the reduction in distortion achieved with the alternative attachment structure of FIG. 11.

Another possible concept for attachment of the reflector material 30 to the front cords 21 is depicted in FIG. 10. This implementation adds radial cords 50 to the cord/tie structure. FIG. 11 illustrates usage of these additional cords by replacing a single tube 40 with four tubes arranged around the tie point 52. The advantage of having the tie point 52 straddled by two tubes 40 is illustrated in FIG. 12. The motion of the tie points as indicated by the arrows creates a distortion as described above and in FIG. 9. However with the pairs of tubes 40 located on either side of the tie point 52, any rotation or bending of the reflector material 30 can now be reacted through the pair of tubes 40 against the tension in the radial cord 50. As the tension in the radial cord 50 is sufficiently large, 1.0 pound or more, it contributes significant restoring moment to maintain the surface in its desired angular orientation. FIG. 12 also points to the need for some minimal distance between the radial cord 50 and the reflector material 30. A standoff 54 achieves this by holding the tubes 40 at an adequate distance away from reflector material 30 so that the radial cord 50 and surface do not interfere with one another at the midpoint of radial cord 50, between the tie points 52. This standoff 54 may be a manufactured part or, should the reflector material 30 have sufficiently small curvature, simply be representative of the bond material that holds the tube 40 to the reflector material 30. FIG. 12 highly exaggerates the expected curvature of actual reflectors to illustrate the attachment geometry. The expectation is that the diameter of the tubes 40 should provide adequate clearance between the reflector material 30 and the radial cord 50 so that direct bonding of tube 40 to the reflector material 30 will be adequate.

What is claimed is:

1. A deployable reflector comprising:

a support structure comprised of a plurality of radially extending support ribs movable from a compact stowed configuration to a deployed configuration, a plurality of circumferentially extending support cords, and a plurality of radially extending support cords to intersecting said plurality of circumferentially extending support cords to define a plurality of tie points, at least a selected portion of said support members defining a prescribed surface when in said deployed configuration, and said support cords defining said prescribed surface between adjacent ones of said support ribs;

a reflector material restrained against said support members defining said prescribed surface, said reflector material comprising a continuous flexible solid surface; and a plurality of tube features through which said support cords are inserted, said plurality of tube features bonded to a backside of said reflector material and arranged around said plurality of tie points.

2. The deployable reflector according to claim 1 wherein said continuous reflector material has a bending stiffness on the order of 0.1 to 10 inch-pounds.

3. The deployable reflector according to claim 1 wherein said continuous reflector material has a coefficient of thermal expansion of less than about $10\times10^{-6}/°$ F.

4. The deployable reflector according to claim 1 wherein said reflector material is a laminate comprising a quartz cloth material pre-impregnated with a resin.

5. The deployable reflector according to claim 1 wherein said reflector material is a laminate comprising graphite and a resin.

6. The deployable reflector according to claim 1 wherein said reflector material is comprised of a reflective layer deposited on an underlying non-reflective layer.

7. The deployable reflector according to claim 1 wherein said prescribed surface has a parabolic or near parabolic shape.

8. The deployable reflector according to claim 1 wherein said reflector material is comprised of a single continuous sheet.

9. The deployable reflector according to claim 1 wherein said reflector material is formed from a plurality of segments attached to form a continuous sheet.

10. The deployable reflector according to claim 1 wherein said reflector material is configured for flexing from said stowed configuration to said deployed configuration.

11. A deployable reflector comprising:

a support structure comprised of a plurality of ribs movable from a compact stowed configuration to a radially extending deployed configuration;

a plurality of circumferentially extending cords defining a prescribed surface between said support ribs when in said deployed configuration; and a continuous reflector material restrained against said cords defining said prescribed surface, said reflector material comprising a flexible solid surface formed to said prescribed surface and free of surface tension when in said deployed configuration.

12. A reflector comprising:

a support structure comprised of a plurality of support members, at least a selected portion of said support members defining a prescribed reflector surface; and a continuous reflector material restrained against said support members defining said prescribed surface, said reflector material comprising a flexible solid surface formed to said prescribed surface and free of surface tension when in said deployed configuration.

13. The reflector according to claim 12 wherein said support structure is a cord and tie structure.

14. The reflector according to claim 13 further comprising at least a first tubular attachment member secured to said reflector material adjacent to a tie point of said cord and tie structure and axially aligned with at least one cord of said cord and tie structure.

15. The reflector according to claim 14 wherein at least one cord of said cord and tie structure passes through an interior of said tubular attachment member.

16. The reflector according to claim 14 further comprising at least a second tubular attachment member secured to said reflector adjacent to said tie point and axially aligned in a generally orthogonal orientation with respect to said first tubular attachment member.

17. The reflector according to claim 14 further comprising a standoff interposed between said reflector material and said tubular attachment member.

18. The reflector according to claim 13 further comprising a plurality of radially oriented cords.

* * * * *

UNITED STATES PATENT AND TRADEMARK OFFICE

CERTIFICATE OF CORRECTION

PATENT NO. : 6,828,949 B2
DATED : December 7, 2004
INVENTOR(S) : Harless

It is certified that error appears in the above-identified patent and that said Letters Patent is hereby corrected as shown below:

Column 9,
Line 49, delete "to".

Signed and Sealed this

Sixteenth Day of August, 2005

JON W. DUDAS
*Director of the United States Patent and Trademark Office*